US008371357B2

(12) United States Patent
Frede

(10) Patent No.: US 8,371,357 B2
(45) Date of Patent: Feb. 12, 2013

(54) SYSTEM TO GUIDE THE SLATS OF AN INDUSTRIAL ROLLER DOOR TO REDUCE DAMAGES AFTER CRASH

(75) Inventor: Friedhelm Frede, Erwitte (DE)

(73) Assignee: Assa Abloy Entrance Systems AB, Landskrona (SE)

( * ) Notice: Subject to any disclaimer, the term of this patent is extended or adjusted under 35 U.S.C. 154(b) by 1550 days.

(21) Appl. No.: 11/348,024

(22) Filed: Feb. 6, 2006

(65) Prior Publication Data

US 2007/0181264 A1 Aug. 9, 2007

(51) Int. Cl.
*E06B 9/56* (2006.01)

(52) U.S. Cl. ..... 160/273.1; 160/133

(58) Field of Classification Search ..... 160/133, 160/273.1, 84.06, 265, 271, 272, 280, 281, 160/288

See application file for complete search history.

(56) References Cited

U.S. PATENT DOCUMENTS

| | | | | | |
|---|---|---|---|---|---|
| 4,649,981 | A | * | 3/1987 | Bibeau | 160/120 |
| 5,025,847 | A | * | 6/1991 | Mueller | 160/270 |
| 5,056,579 | A | * | 10/1991 | Krafutler | 160/271 |
| 5,139,074 | A | * | 8/1992 | Warner | 160/271 |
| 5,141,044 | A | * | 8/1992 | Hying et al. | 160/271 |
| 5,222,541 | A | * | 6/1993 | Hornberger | 160/265 |
| 5,271,448 | A | * | 12/1993 | Delgado | 160/265 |
| 5,392,836 | A | * | 2/1995 | West et al. | 160/273.1 |
| 5,620,039 | A | * | 4/1997 | Delgado et al. | 160/265 |
| 5,720,332 | A | * | 2/1998 | Nachreiner | 160/205 |
| 5,964,271 | A | * | 10/1999 | Lapointe | 160/273.1 |
| 6,035,918 | A | * | 3/2000 | Kraeutler | 160/84.06 |
| 6,119,758 | A | * | 9/2000 | Coenraets | 160/273.1 |
| 6,123,139 | A | * | 9/2000 | Kalempa et al. | 160/188 |
| 6,296,039 | B1 | | 10/2001 | Mullet et al. | |
| 6,397,916 | B1 | | 6/2002 | Bengtsson et al. | |
| 6,615,898 | B2 | | 9/2003 | Schulte | |
| 6,883,577 | B2 | | 4/2005 | Frede | |
| 2003/0047291 | A1 | | 3/2003 | Klein | |
| 2004/0163777 | A1 | * | 8/2004 | Frede | 160/268.1 |
| 2004/0173326 | A1 | | 9/2004 | Dittmer | |

FOREIGN PATENT DOCUMENTS

| | | |
|---|---|---|
| EP | 1 528 218 A | 5/2005 |
| WO | WO 00/60208 | 10/2000 |
| WO | WO 01/69032 | 9/2001 |
| WO | WO 03/018950 | 6/2003 |
| WO | WO 2004/076795 | 9/2004 |

* cited by examiner

*Primary Examiner* — David Purol

(74) *Attorney, Agent, or Firm* — Frommer Lawrence & Haug LLP; Ronald R. Santucc

(57) ABSTRACT

A method and apparatus for preventing damage to an industrial door during an impact, the apparatus including a roller door having a plurality of lamellae, and a plurality of end pieces connectable to the lamellae. The industrial door also includes a drive system, connectable to the plurality of end pieces for raising and lowering the door. The lamellae include a plurality of openings formed therein and, arranged on at least one distal end thereof. The end pieces include a plurality of friction fit security devices for engaging the openings.

11 Claims, 6 Drawing Sheets

SYSTEM TO GUIDE THE SLATS OF AN INDUSTRIAL ROLLER DOOR TO REDUCE DAMAGES AFTER CRASH

FIELD OF THE INVENTION

The present invention is directed to method and devices for the prevention of damage to industrial doors in the event of an impact. More particularly, the present invention is directed to preventing damage to end pieces and drive systems of industrial doors in the event of an impact.

BACKGROUND OF THE INVENTION

Since the 1970's there has been a great need to use rapidly moving doors in buildings for industrial use, collectively referred to as industrial doors. This applies to openings indoors as well as in external walls, where the door provides shielding between different activities or prevents drafts and heat losses. One type of industrial doors are, rolling doors. Rolling doors are often formed with flexible door leaves are used for this purpose, but also more rigid constructions like slatted doors with polymeric or metallic lamellae are used. In one known example, these doors are rolled up on an overhead drive cylinder or on two independently driven disks and can be provided with additional elements like transverse wind reinforcements on the door leaf to counteract wind load, a weight balance system, tensioning system, windows or the like. For safety reasons, rolling doors can be further provided with safety edge protection, failsafe devices, drop protection, and crash safety functions.

In most vertically running roller door assemblies, the doors typically run between two rigid door guides. This results in the door and more particularly the door leaf running in an opening in the guide.

Another known industrial door is the vertical lifting door, where the door is lifted either straight up, or at an angle in order to open the door and allow a user to pass therethrough.

In some instances, a roller door or vertical lifting door will be connected to either flexible pulling devices hinge belts, traditional stiff hinges, or a sealing material that tends to yield on impact. One example of such a devices and be found in the commonly assigned PCT application WO 04/076795, which is incorporated herein by reference. The advantage of these devices is that they assist in increasing the speed of the door. Generally the lamellae are laterally connected to the flexible pulling devices or hinge belts. These hinge belts or pulling devices are positioned in the guide of the door and are closely connected to the lamellae either by direct connection or via an end piece which itself is connected to the lamellae. In the event of a crash the end piece may be pulled out of the guide and off the hinges. Alternatively the pulling belts can be torn off. To rebuild the door then takes considerable amounts of time and effort.

In WO 03/018950 there is described a lifting door system which assists in reducing the damage caused by crashes. In the system the described in the '950 application, the end pieces are movably connected to the lamellae, this is typically a horizontally movable connection. As a result when impacted up to a certain point, the lamellae simply move in the joint between the lamellae and the end piece and no damage is done to either the lamellae or the end piece. However, if the impact is severe, and the movement of the lamellae is such that it exceeds the distance provided for in the end piece, the movement of the lamellae may cause damage to the lamellae, the driving components, or the end pieces. Alternatively, the lamellae may be connected to the end piece with a breakable connection, wherein the breakable connection allow the lamellae to break away from the end pieces of the door, and limit the damage to these end pieces.

This lifting door system, however, has certain disadvantages including the inability to optimize the performance of the door, and more importantly, during times of very high wind forces, the lamellae can actually be forced out of the end piece. As is readily apparent such an arrangement provides limited security and may be susceptible to burglary or intruders. In the case where the end pieces have a set breaking point, both parts the lamellae and the end piece may be damaged at a breakage and require replacement.

While some of the foregoing references have certain attendant advantages, further improvements and/or alternative forms, are always desirable.

SUMMARY OF THE INVENTION

One objective of the present invention is directed to a high speed roller door wherein upon impact or a crash only the lamellae will be damaged but the end pieces and the pulling devices will remain undamaged.

Another objective of the present invention is to provide a connection between the lamellae and the end pieces that will increase the security and decrease the likelihood that either the wind or burglars can open the door or remove it from its guides.

Another objective of the present invention is directed to a roller door having an increased resistance to wind pressure while maintaining its resistance to crashes and impact.

Yet a further objective of the present invention is directed to a roller door wherein in the event of an impact breaking the lamellae, the end pieces remain re-usable.

One aspect of the present invention is directed to an industrial door including a plurality of lamellae, and a plurality of end pieces connectable to the lamellae. The industrial door also includes a drive system, connectable to the plurality of end pieces for raising and lowering the industrial door. The lamellae include a plurality of openings formed therein and, arranged on at least one distal end thereof. The end pieces include a plurality of friction fit security devices for engaging the openings.

Another aspect of the present invention is directed to a method of preventing damage to an industrial door including steps of providing an industrial door including a plurality of lamellae, a plurality of end pieces connectable to the lamellae, a drive system connectable to the plurality of end pieces for raising and lowering the industrial door, a plurality of openings formed in the lamellae, arranged on at least one distal end thereof, a plurality of friction fit security devices formed on the end pieces, and at least one guide. The method also includes steps of inserting the lamellae onto the end pieces so that the friction fit security devices engage the openings formed on the lamellae, wherein in the event of an impact damage to the door is prevented by the steps of sliding of the end piece in a direction towards the guides, until the guides are impacted by a wind anchor formed on the end piece. Overcoming the friction force holding the friction fit security device in the opening, and sliding the lamella off of the end of the end piece.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

Figure 1:
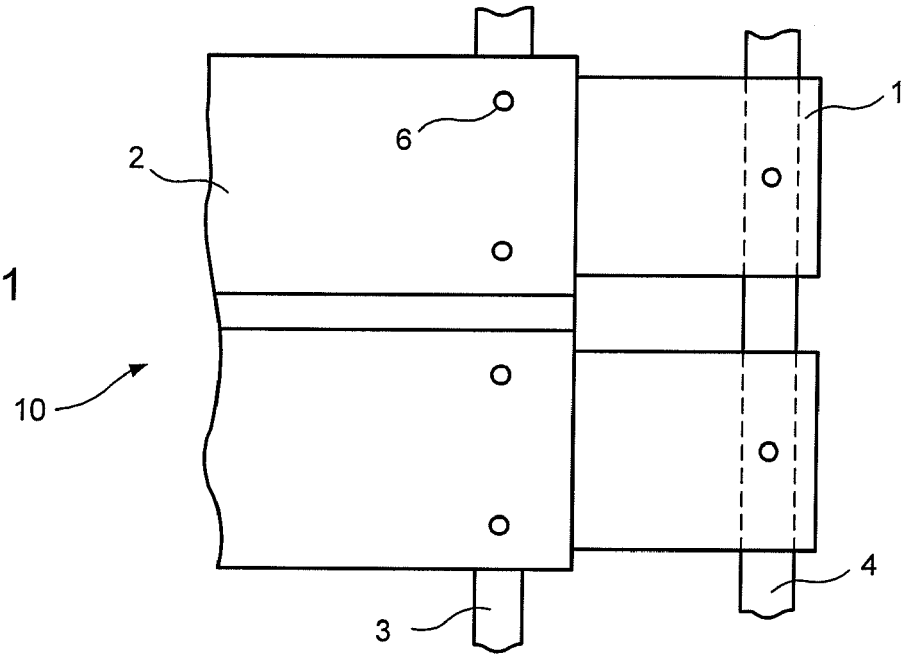
FIG. 1 is a front view of a roller door according to one aspect of the present invention.
Figure 1A:
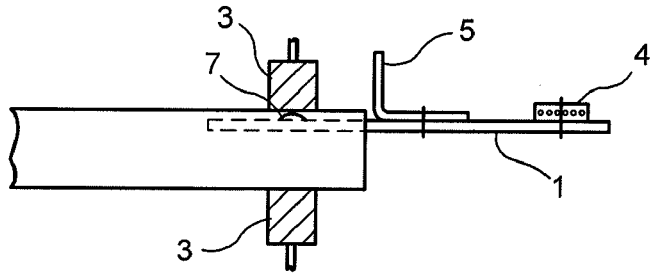
FIG. 1*a* is a top cross-sectional view of a roller door according to one aspect of the present invention.
Figure 1B:
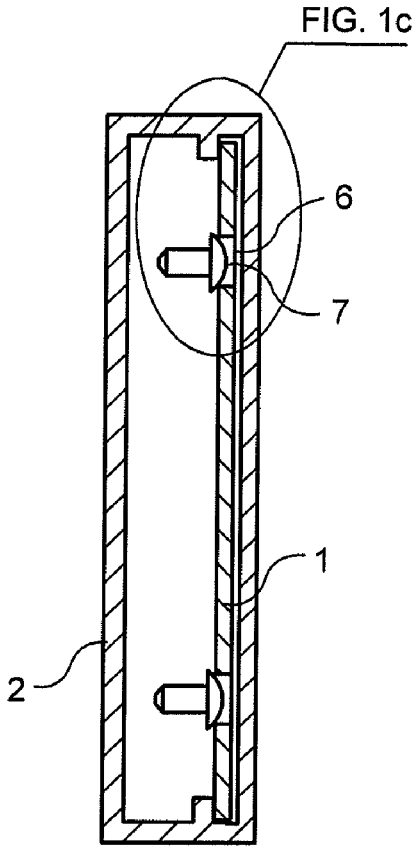
FIG. 1*b* is a side cross-sectional view of a roller door according to one aspect of the present invention.
Figure 1C:
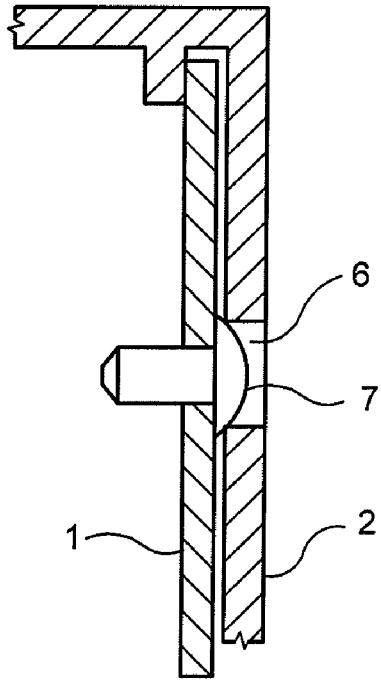
FIG. 1*c* is a close-up of the area designated X in FIG. 1*b;*

The objectives of the present invention, namely the increase in wind resistance, an increase in burglar protection, and being operable to be used repeatedly, are met by a device as show in FIGS. 1 and 1*a*.

FIG. 1 shows an industrial door illustrated by, for example, a roller door 10 which includes a plurality of lamellae 2. The lamellae 2 are each connected to an end piece 1, which itself is fastened to a pulling device 4. The end piece 1 includes a wind anchor 5, as shown in FIG. 1*a*. A guide 3 is formed on both sides of the lamellae and in operation the lamellae 2 ride in the guide track formed by the two guides 3. The lamellae 2 are formed with holes 6 through which a rivet or round-head elements 7, connected to the end piece 1 secures the lamellae 2 between the guides and to the end piece 1 allowing the roller door 10 to be driven by the pulling device, either opening or closing the roller door.

Figure 2A:
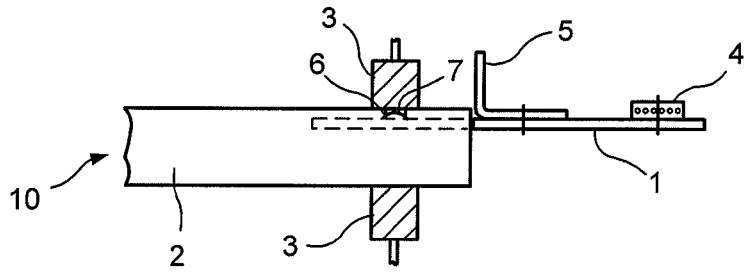
FIG. 2*a* is a top cross-sectional view of a roller door according to one aspect of the present invention showing an end piece in its starting position.
Figure 2B:
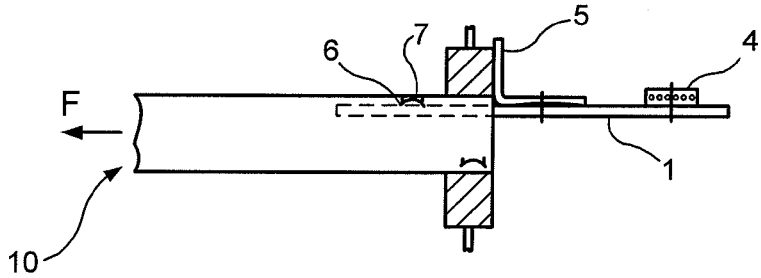
FIG. 2*b* is a top cross-sectional view of a roller door according to one aspect of the present invention showing an end piece under wind pressure.
Figure 2C:
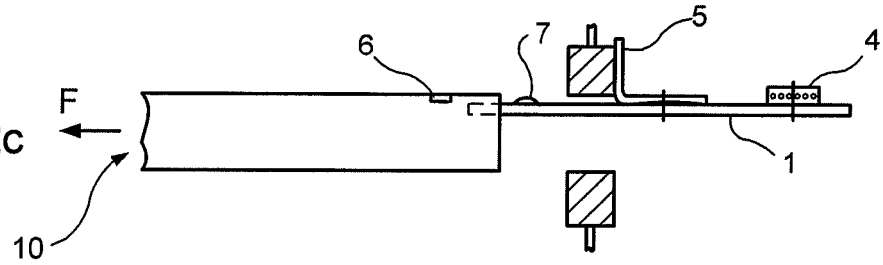
FIG. 2*c* is a top cross-sectional view of a roller door according to one aspect of the present invention showing an end piece where the reusable connection has been overcome by a crash.

FIGS. 2*a-c* show a roller door 10 experiencing the effects of a crash or impact. In FIG. 2*a* the end piece 1, is connected to the pulling device 4 via a sliding connection, not shown. The sliding connection allows the end piece 1 to move in the direction of the lamellae 2 upon application of a force (F) perpendicular to the lengthwise direction of the lamella 2. Upon application of such a force, the end piece moves in the direction of the guides 3 until the wind anchor 5 contacts the guides. The wind anchor 5, which is rigidly connected to the end piece 1, prevents the lamella 2 from being removed from the guides by the simple impact of the wind, and provide for some security from burglars. Upon impact of a force greater than what is typically associated with the wind, for example the impact of a truck or a forklift, as may occur in a warehouse situation, the lamella 2 moves in the direction away from the end piece 1, which is prevented from moving by the wind anchor 5. The lamella 2 is held onto the end piece by the round head elements 7, however, upon application of sufficient force, the lamella 2 in the area of the holes 6 is elastically deformed sufficiently to allow the lamella 2 to slide over the round head element 7, and move in the direction away from the end piece 1. This releases the lamella 2 from the roller door 10.

The lamella 2 can be replaced on the end pieces 1 by simply re-inserting the lamella on the end pieces and sliding the lamella until the round head elements 7 are again located in the holes 6 of the lamella 2. In the event one or more of the lamellae are damaged individual lamella can be replaced with new lamella.

It will be readily apparent to those of skill in the art that the advantages of the roller door 10 described above include the ease with which the door can be restored to working order in the event of a crash. In addition, the system will in most instances prevent any damage being done to the pulling device 4 or to the end pieces 1.

Figure 3A:
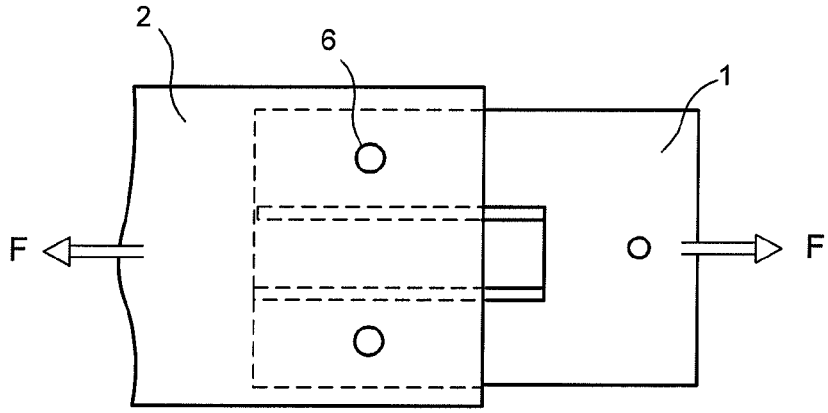
FIG. 3*a* is a front view of a reusable snap connection according to one aspect of the present invention.
Figure 3B:
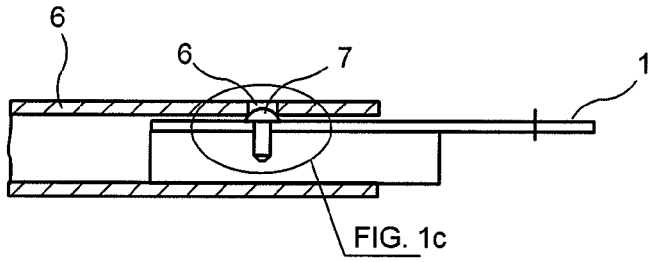
FIG. 3*b* is a top cross-sectional view of a reusable snap connection according to one aspect of the present invention.
Figure 3C:
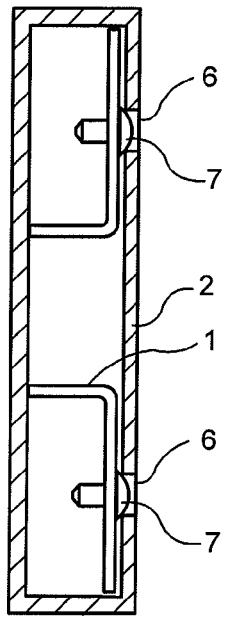
FIG. 3*c* is a side view of a reusable snap connection according to one of the aspects of the present invention.

FIGS. 3*a* and *b* depict a top and side view of one aspect of the present invention. As shown in FIG. 3*a*, the lamella 2 has two holes 6 in which the round head elements 7 rest when the lamella 2 is properly connected to the end piece 1. In addition FIG. 3*a* shows the direction of the forces (F) which will result in the release of the lamella 2 from the end piece 1. These forces are as previously described in the lengthwise direction of the lamella 2. FIG. 3*b* shows how the round head element 7 rests in the holes 6 of the lamella 2, when in the secured position.

Figure 4A:
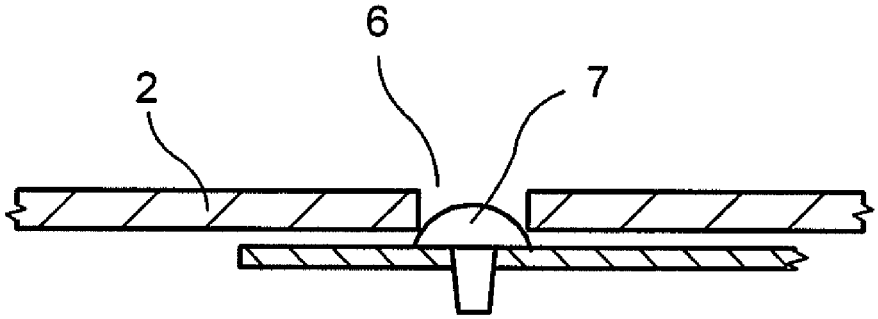
FIG. 4*a* is a side view of a reusable snap connection utilizing a rivet.
Figure 4B:
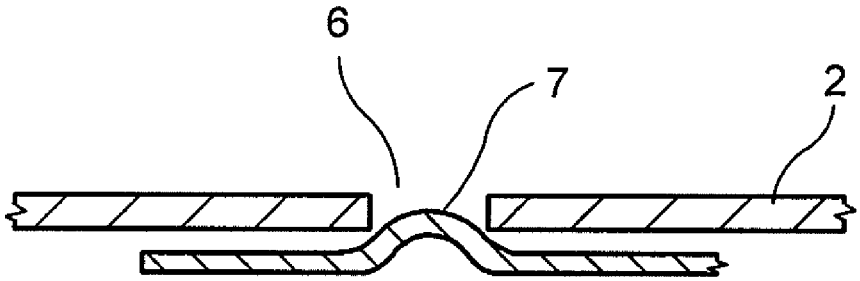
FIG. 4*b* is a side view of a reusable snap formed of the material of the lamella.

FIGS. 4*a* and *b* show two different possible designs for the round head element 7. In FIG. 4*a*, the round head element 7 is in fact a round head rivet which is inserted in a hole formed in the end piece 1 by riveting methods known to those of skill in the art. Another aspect of the present invention is the round head element 7 shown in FIG. 4*b*, wherein a portion of the end piece is deformed substantially perpendicularly to the plane of the end pieces 1. As with the rivet shown in FIG. 4*a*, the deformed portion of the end piece 1 fits into the holes 6 in the lamellae 2 to prevent undesirable movement of the lamellae 2.

It will be apparent to those of skill in the art that the foregoing examples of the round head elements 7 need not be round and may take any shape desired by the manufacturer including wedges, ridges, and the like. Accordingly, though described herein as round head elements, these devices are in fact securing devices and may be of any shape. Similarly, the holes 6 are not limited to round holes as shown but may be slots, square holes, ribs with no opening in the lamellae, or any friction fit security device known to those of skill in the art.

It will also be readily apparent to those of skill in the art that though shown here with holes extending through the lamellae, the holes 6 do not have to necessarily extend through the surface of the lamella and pockets may be formed in the inside of the lamellae where the round head elements rest while securing the lamellae to the end pieces.

Yet a further feature one of skill in the art would understand is that the round head elements 7 may be formed on the lamellae and the holes on the end pieces. Operation of such a configuration is similar to that described above.

Figure 5:
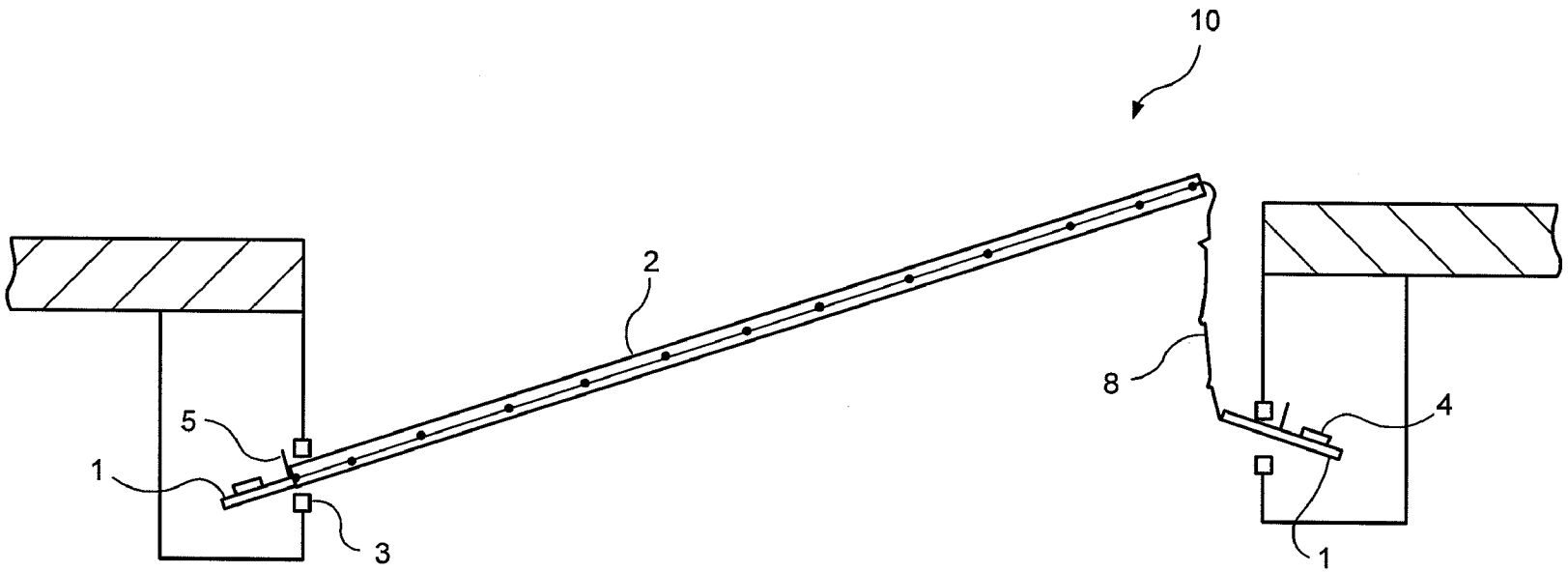
FIG. 5 is a perspective view of a lamella according to one of the aspects of the present invention, wherein the lamella is supported by a safety device following a crash or high wind removing it from the end piece.

A further aspect of the present invention can be seen with reference to FIG. 5. In FIG. 5, a lamella 2 in accordance with the above described aspects is shown. The lamella 2 includes end pieces 1 on each end of the lamella as well as pulling devices 4. The lamella 2 rides in the guide 3, and the end pieces 5 are shown on both ends of the lamella 2. Also incorporated in to the lamella is a safety device 8. The safety device 8 may be a rope, cord or line, or a bungy cord or other retention device that will permit movement of the lamella 2 from the end pieces 1, but substantially retains the lamella 2 connected with the remainder of the door 10. As shown in FIG. 5 the safety device 8 is connected at both ends of the door 10, however, the safety device may also be two separate pieces of cord, rope, or elastic attached at the two ends of the door 10. Yet a further embodiment may include only a single safety device 8 formed on a single end of the door 10. The use of the safety device 8 may be particularly useful in applications where it is desirable to limit the swing-out of the lamella 2 in one direction or both, and prevent damage to surrounding surfaces or to the lamellae themselves. In such instances, the elasticity of the safety device 8 may be chosen accordingly.

Thus by the foregoing examples, the objects and advantages of the present invention are realized, and although preferred embodiments have been disclosed and described in detail herein, its scope and objects should not be limited thereby; rather its scope should be determined by that of the appended claims.

What is claimed is:

1. An industrial door comprising:

a plurality of lamellae;

a plurality of end pieces connectable to the lamellae, a drive system connectable to said plurality of end pieces for raising and lowering the roller door;

a plurality of openings formed in the lamellae, arranged on at least one distal end thereof and extending in the direction of the lamellae; and a plurality of friction fit security devices formed on the end pieces, for slidably engaging the openings wherein the friction fit security devices slidably release from the openings and the end pieces move in a direction parallel to the length of the lamellae in response to a force applied generally perpendicular to the lamellae.

2. The industrial door of claim 1, further comprising a wind anchor.

3. The industrial door of claim 1, wherein the end pieces include a sliding engagement member for connection to the drive system.

4. The industrial door of claim 1, wherein upon application of sufficient force to the roller door, the friction fit security devices are overcome allowing the lamellae to move away from the end pieces.

5. The industrial door of claim 1, further comprising guides for directing the path of the roller door during opening and closing thereof.

6. The industrial door of claim 5, further comprising a wind anchor formed on one or more of the plurality of end pieces and wherein upon application of sufficient force the wind anchor impacts the guides preventing further movement of the end piece.

7. The industrial door of claim 1 wherein the friction fit security device is selected from the group consisting of a round head rivet, a deformation formed in the end piece, a ridge formed on the end piece substantially perpendicular to the lengthwise direction of the lamellae, and a wedge shaped protrusion attached to the end piece.

8. The industrial door of claim 1, wherein the opening is selected from the group consisting of a round hole, a square hole, a ridge for interaction with a wedge formed on the end piece, and a pair of ridges for interaction with a ridge formed on the end piece.

9. The industrial door of claim 1, wherein the openings and friction fit security devices are located on both ends of the lamellae.

10. The industrial door of claim 1 further comprising a safety device, limiting the travel of the lamellae when removed from the end pieces.

11. A method of preventing damage to a roller door comprising the steps of:

providing a roller door including a plurality of lamellae, a plurality of end pieces connectable to the lamellae, a drive system connectable to the plurality of end pieces for raising and lowering the roller door, a plurality of openings formed in the lamellae arranged on at least one distal end thereof, a plurality of friction fit security devices formed on the end pieces, and at least one guide, inserting the lamellae onto the end pieces so that the friction fit security devices engage the openings formed on the lamella, wherein in the event of an impact damage to the door is prevented by the steps of:

sliding of the end piece in a direction towards the guides, until the guides are impacted by a wind anchor formed on the end piece;

overcoming the friction force holding the friction fit security device in the opening; and sliding the lamellae away from the end piece.

* * * * *